United States Patent [19]

Ernest et al.

[11] 3,964,445

[45] June 22, 1976

[54] WATER COOLING SYSTEM – WANKEL ENGINE

[75] Inventors: Robert P. Ernest, Dearborn Heights; Charles M. Jones, Detroit; Edwin J. Ounsted, Dearborn; Hai Wu, Northville, all of Mich.

[73] Assignee: Ford Motor Company, Dearborn, Mich.

[22] Filed: May 3, 1974

[21] Appl. No.: 466,652

[52] U.S. Cl. ..... 123/8.01; 418/83

[51] Int. Cl.[2] ..... F02B 55/10

[58] Field of Search ..... 418/60, 61, 83, 88; 123/8.01, 8.07

[56] References Cited

UNITED STATES PATENTS

| | | | |
|---|---|---|---|
| 2,971,500 | 2/1961 | Bancroft | 123/8.07 |
| 3,102,516 | 9/1963 | Gist et al. | 418/83 X |
| 3,280,802 | 10/1966 | Froede | 123/8.01 |
| 3,286,700 | 11/1966 | Froede | 418/83 X |
| 3,298,330 | 1/1967 | Ito et al. | 418/83 X |
| 3,313,276 | 4/1967 | Ito et al. | 418/83 X |
| 3,644,070 | 2/1972 | Lermusiaux | 418/83 X |
| 3,695,790 | 10/1972 | Jones | 418/83 |
| 3,836,293 | 9/1974 | Lamm | 418/83 |

FOREIGN PATENTS OR APPLICATIONS

| | | | |
|---|---|---|---|
| 926,209 | 5/1963 | United Kingdom | 123/8.01 |

*Primary Examiner*—C. J. Husar
*Assistant Examiner*—Leonard L. Smith
*Attorney, Agent, or Firm*—Joseph W. Malleck; Keith L. Zerschling

[57] ABSTRACT

A rotary engine employing an improved circumferential flow cooling system is employed to provide an increase in fuel economy and engine efficiency. Each housing unit has its own distinct flow circuit with the total volume of cooling medium being variably distributed among such units. The circuits employ flow foils, flow turbulizers, velocity variation and a variable epitrochoid wall thickness to provide flow characteristics which vary along the stations of the circuit. The variations promote a more uniform engine wall temperature throughout, the coolant can be operated at a higher overall temperature, and heat is transferred (extracted or injected) on a programmed basis along the flow circuit as needed.

19 Claims, 16 Drawing Figures

20
(A)
(B)
229°F
208°F
210°F
250°F
236°F
247°F
290°F
340°F
375°F
410°F
425°F
265°F
279°F
318°F
307°F
279°F
257°F
250°F
292°F
278°F
345°F
363°F
342°F
300°F
303°F
305°F
30
32
33
Temperature (°F)
Location
410
400
390
380
370
360
350
340
330
320
310
300
290
280
270
260
250
240
230
220
210
200
1
2
3
4
5
6
7
8
9
10
11
12

WATER COOLING SYSTEM – WANKEL ENGINE

BACKGROUND OF THE INVENTION

The rotary internal combustion engine has a unique dynamic thermal problem because the epitrochoid surface of the rotor housing experiences wide variations in temperatures at different locations therealong. This is due in part to the fact that the three combustion chambers are fired at the same location by the same spark plugs resulting in an extremely high surface temperature in the localized area about the firing point. In fact, this localized area runs considerably higher in temperature than a reciprocating engine cylinder barrel. To further amplify the temperature problem, the same intake port operates to charge each of the three combustion chambers resulting in an exceedingly low epitrochoid surface temperature near such intake port. It has been found through test analysis of a commercial engine, such as the Mazda type now commercially available, that the temperature variation of the epitrochoid surface was exceedingly wide; it varied from 208°F to 460°F at 6,000 r.p.m. (wide-open throttle). The cooling system of the commercial Mazda type engine is of the type where the cooling water traverses each of the housings to complete a circuit.

This wide temperature variation leads to improper lubrication between the apex seal and the epitrochoid surface. In those areas where the low temperatures are experienced along the epitrochoid surface, the oil lubricant tends to ball-up ahead of the apex seal. In those areas where high temperatures are experienced, the lubricant cannot keep the epitrochoid surface sufficiently wet because of the excessive surface temperature; this results in a high friction condition between the apex seal and the epitrochoid surface which induces "chatter". Chatter is a phenomenon resulting from the apex seal momentarily leaving the epitrochoid surface and then returning to dig into the surface. A rotor housing having a high degree of chatter will show closely spaced transverse lines or grooves in certain quadrants of the rotor housing. Obviously, the grooves themselves are a detriment to proper sealing.

Yet still another thermodynamic problem, unique to the rotary internal combustion, is the high amount of unused heat that is rejected by the engine. Because of the general geometry of a rotary internal combustion engine, as compared to an average reciprocating engine, the large surface-to-volume ratio of the combustion chamber results in a theoretical transmission of considerably greater amounts of heat to the coolant and/or oil. Heat rejection tests confirm this fact. The rotary internal combustion engine also has a longer expansion stroke than a similar reciprocating engine. In some respects, this is a good factor because it eliminates torque reversals in the engine and the engine runs much smoother. On the negative side, the longer expansion stroke permits a greater amount of time for heat to be transmitted through the walls of the combustion chamber.

Materials Selection has been hampered by the thermodynamic problems. The uneven temperature distribution about the epitrochoid surface is one of the road blocks to utilization of cast iron for the rotor housing. Typically, aluminum, because of its excellent heat transfer qualities, has been the only material used for rotor housings. But under severe operating conditions and events, certain structural changes can occur in the aluminum as a result of the uneven temperature distribution: (a) repeated thermocycling can result in cracks around the spark plug holes, (b) distorted housings can deteriorate the gas, oil and coolant sealing systems, and (c) in an engine equipped with an aluminum rotor housing sandwiched between cast iron side housings collapse of the aluminum housing could occur. The temperature danger level appears to be approximately 400°F for the above problems to occur.

Any solution to the thermodynamic problem must contend with the type of cooling systems used by the prior art. The most prevalent prior art engine used commercially is that of the current Mazda engine which employs an axial-flow cooling system. The term axial flow is used here to mean that the fluid enters at one side wall of the composite of housings and moves through each housing. Fluid transfers to the next housing in an axial direction parallel to the axis of the rotary shaft of the engine. This necessitates that the five major housings (to constitute a two rotor engine) be sealed on the four main surfaces to prevent coolant leaks externally and internally. The housings of the Mazda engine employ a large number of O-rings, eight of which are very large. These five housings also require the use of an extremely large number of tie bolts to hold the housings securely together and to compress the O-rings for preventing leakage. The bolts are extremely long and after torquing these bolts to a final installed condition, excessive twisting may occur making it very difficult to maintain proper compressive force.

Several engines of the Mazda type have failed in hot and cold cycling tests and particularly in the O-ring seal area because of inadequate torque on the tie bolts. All of the problems associated with uneven heat transfer outlined in previous paragraphs are experienced with the Mazda engine.

Other prior art cooling systems have included peripheral flow of the cooling fluid within a single housing, such as an end housing or a rotor housing. But in almost all cases the definition of the housing cooling circuit has required the use of end plates to complete the internal flow passages and these plates in turn required sealing members reverting back to the original problems of the Mazda engine.

Some attempt has been made by the prior art to vary the cooling capacity of the cooling circuit in an axial flow or peripheral flow arrangement. These attempts have been primarily on a mathematical concept basis and have not developed suitable practical implementation to obtain the desired goals as set forth by such mathematical analysis. One attempt has utilized curved ribs in the side housing circuit in the hope of increasing heat extraction since the ribs would function as a heat sink; such ribs were not contoured with the intent of varying the flow character, or varying the flow speed or even the flow volume distribution. Yet still other prior art attempts have introduced the oil cooling system adjacent the water cooling system with the hope that each would be capable of extracting heat at different rates at different portions of the epitrochoid surface. Although each of these prior art attempts have contributed some degree of improvement to the very severe problem of temperature variation, they have not been totally satisfactory from the standpoint of optimum fuel consumption and engine efficiency when viewed thermodynamically or mechanically. Specifically the prior art has been deficient in inappropriate variation of the flow velocity, improper character of the flow at various locations around the epitrochoid surface, little or no variation of the total volume of fluid between the separate housings. It is with this total combination of requirements in mind that the present invention has been developed.

SUMMARY OF THE INVENTION

A primary object of this invention is to provide a cooling system for a rotary engine which reduces FMEP (friction mean effective pressure) and reduces engine heat losses so that improved fuel economy and engine efficiency can be realized. More particularly, it is an object to provide a predetermined variable heat extraction balanced to maintain the trochoid wall temperature within narrow uniform temperature limits by: redefining the engine trochoid wall thickness; redefining the cooling flow channels in such respects as entrance and exit, proportioning the main channel with respect to the area of contact of hot gases with the trochoid wall, and distribution between and with respect to a radius of the circuit; redefining the flow character and rate within each flow circuit to selectively control the boiling mode on an inverted surface or by promoting attached streamlined flow; and redefining the coolant and/or its operating temperature level.

It is another object of this invention to provide a rotary internal combustion engine having a water cooling system arranged to be divided into separate circuits for each housing element of the engine, the flow characteristic being varied in each circuit, the flow volume is varied between the circuits, and the flow velocity is varied within each circuit; all of such variations are a combination improvement in a novel manner over the prior art.

Specific features pursuant to the above objects comprise the use of separate self-contained housings each having their own peripheral water cooling circuit and each having a volume distribution potentially different than the other housings; inlet or outlet controls are used for the various circuits to proportion the total volume flow therethrough in a manner unlike prior art; diverter elements are used to vary the velocity within a single circuit; auxiliary turbulizer elements are used to purge the underside of the epitrochoid surface where ebullience is occurring, and the thickness of the epitrochoid wall is varied in a predetermined manner.

Yet still another object of this invention is to provide a circumferential-type cooling arrangement for a rotary internal combustion engine which is flexible to operate with a variety of coolant mediums, such as water or methoxy propanol, each of which may lend themselves to nucleate boiling requiring a condenser as opposed to a radiator.

DETAILED SPECIFICATION

Basic Problem - Temperature Variation about the Epitrochoid Surface

Figures 1, 2:
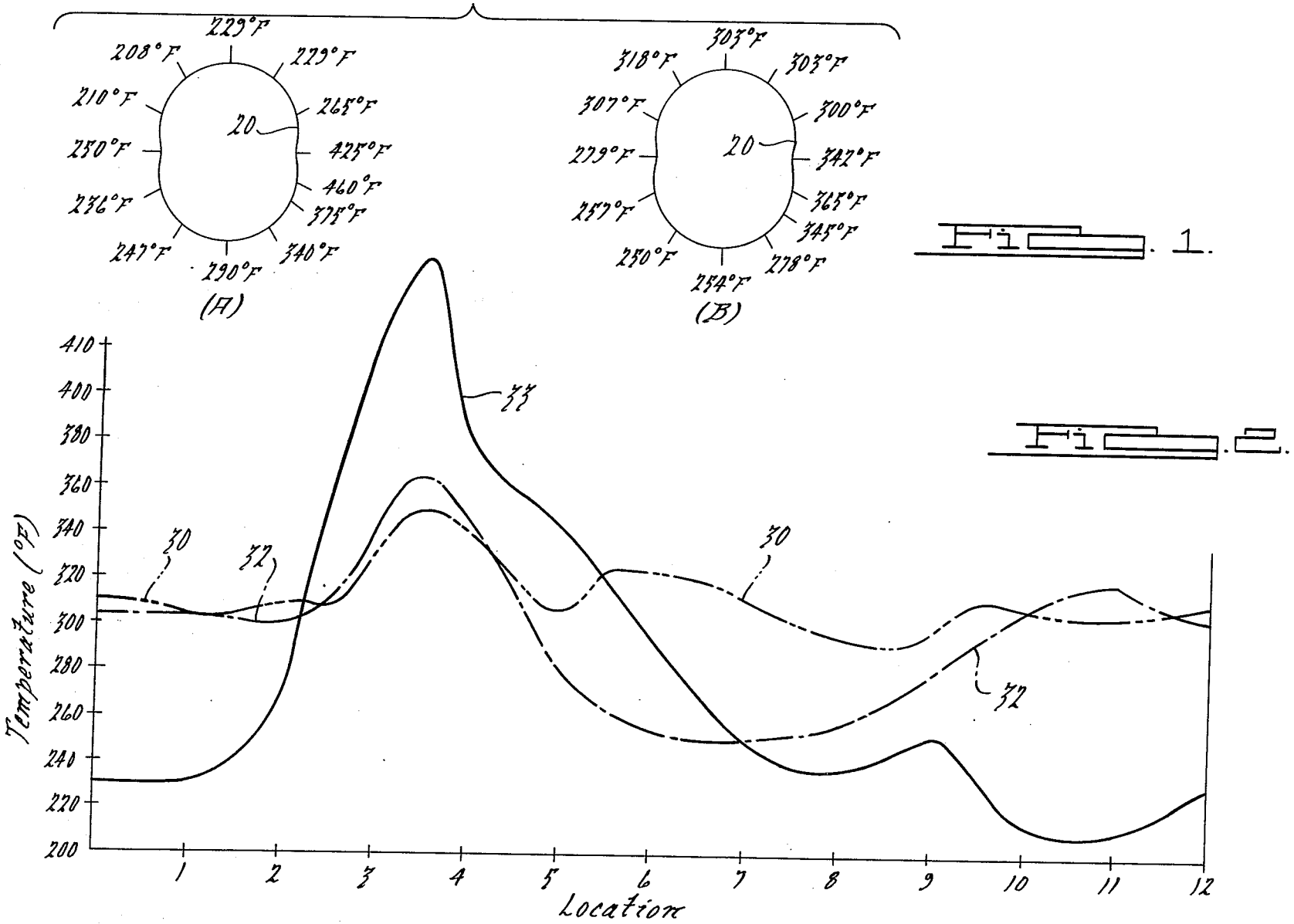
FIG. 1 is a schematic plot of two epitrochoid walls having operating temperature data designated thereabout, one for a prior art construction and the other for the inventive construction.
FIG. 2 is a graphical illustration of wall temperature data plotted as a function of station along the epitrochoid wall, the curves represent various embodiments.

The rotary engine has a unique temperature problem around the epitrochoid surface due to the fact that the three combustion chambers fire at the same point by the same spark plugs. This causes the surface temperature in this particular area to run much hotter than a reciprocating engine cylinder barrel. In addition, the same intake port charges each of the three combustion chambers resulting in a lower trochoid surface near the intake port. Turning to FIG. 1, a schematic illustration is shown for temperature data collected at various points (equivalent to the hours of a clock) around the epitrochoid surface 20 for an engine (A) having an axial flow commercial type cooling system, and for an engine (B) incorporating the principles of this invention. The temperatures for prior art engine A varies from 208°F to 460°F at 6,000 r.p.m. wide open throttle. For inventive engine B, the variation is from 250°F to 365°F at 6,000 r.p.m. wide open throttle, a desirable temperature variation but not optimized in accordance with further teachings herein. Preferably, the objective temperature range should be between 300°–350°F.

FIG. 2 shows temperature variation of the epitrochoid wall depicted as a running plot for the radial locations (corresponding to the numbers of a clock) as one proceeds about the wall 20 of FIG. 1. Plot 33 represents actual engine temperature measurements for a typical prior art Mazda engine. Plot 32 represents mathematically predicted temperature variations for an engine having circumferential flow and certain other features of this invention. Plot 30 represents an engine employing the full combination of features taught by this invention including wall thickness variations in the cold sector, which obviously results in a synergistic effect to stabilize the wall temperature with a variation no greater than 50°F.

Obtaining this fundamental goal of a predetermined variable heat extraction balanced to maintain the trochoid wall temperature within narrow uniform limits, the engine will have lower FMEP (friction means effective pressure) and lower heat losses.

Rearrangement of Flow Channels

Figure 3:
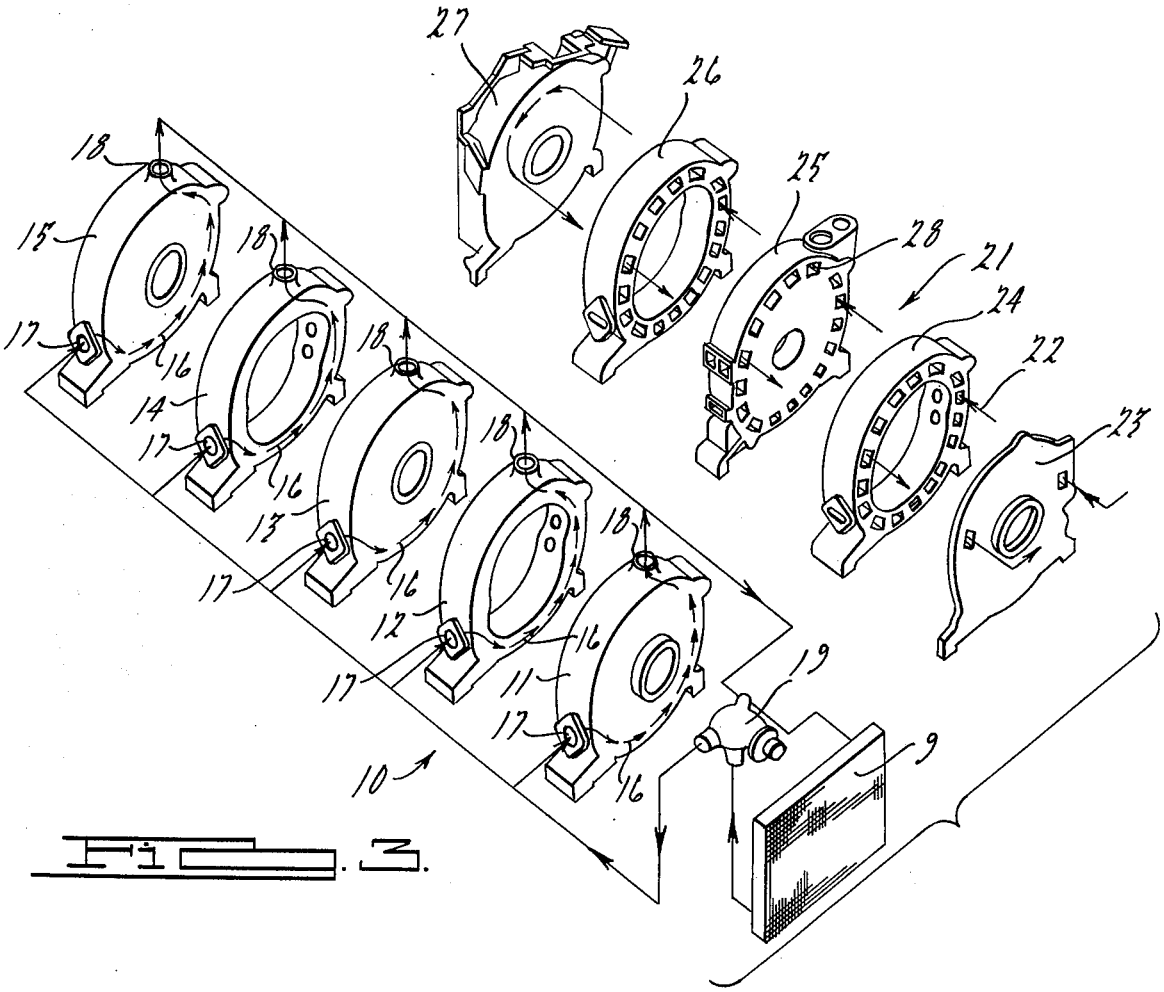
FIG. 3 is a schematic exploded view of two engines, one employing the cooling system design of this invention and the other employing a representative prior art cooling system.

As shown in FIG. 3, this invention utilizes a circumferential flow cooling system that has been advanced by utilizing self-contained unitary housing units 11, 12, 13, 14 and 15 stacked together in a series and held together by a smaller number of assembly bolts (not shown) since seal compression between the respective housings is not required. Circumferential flow circuits 16 are primarily directed along only a predetermined quadrant of each respective epitrochoid surface; water will enter each housing at an independent entrance 17 having a substantially tangentially directed inlet throat area disposed at the 7 o'clock position. The flow in the rotor housings 12 and 14 passes along the inverted surfaces and then is directed upwardly to exit from an outlet 18 located approximately at the 1 o'clock position or in an upper zone of the epitrochoid surface. In the side housings 11, 13 and 15, the flow circuit 16 passes arcuately along the vertically oriented wall of the trochoid chamber and also exits at about the 1 o'clock position. The circuits 16 are arranged in parallel and a common pump 19 operates to pressurize the entire system for conveying the cooling water to a radiator 9.

In comparison, the cooling system 21 of a typical commercial rotary engine utilizes axial flow circuits 22, each traversing all of the housing units 23, 24, 25, 26 and 27 of such an engine. The flow passes through a number of openings 28 which are arranged throughout all quadrants of the epitrochoid walls and side housing walls. Local control of the flow is almost impossible.

Figure 4:
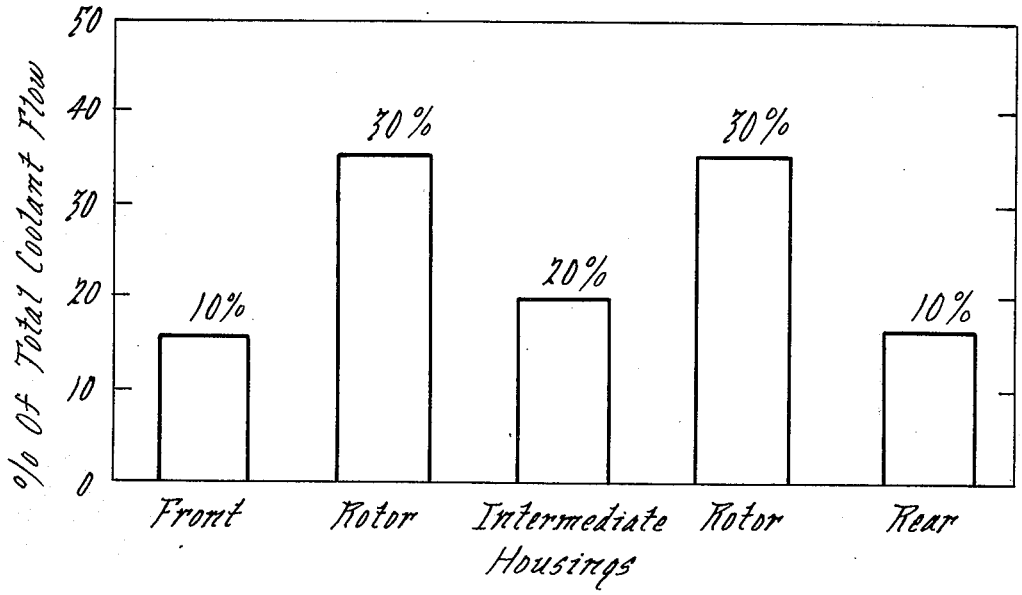
FIG. 4 is a graphical illustration of cooling flow volume distributed among the several housing units.

Each of the housing units of system 10 of this invention (the rear side housing 15, rear rotor housing 14, intermediate housing 13, front rotor housing 12, and front side housing 11) each have an integrally cast water jacket with its own independent passages. The use of separate and independent integrally cast water jackets permits variations of flow within each housing unit. The flow channel within the side housings has a variation in cross-sectional area of at least 400%; the flow channel in the rotor housings has a variation in cross-sectional area less than 200%. As shown in FIG. 4, the coolant flow rate for one of the early engines herein in terms of gallons per minute was varied between the individual housings so that the front and rear side housings 15 and 11 received a flow rate of about 15 and 16 g.p.m. respectively (about 10% of total flow); the rotor housings 14 and 12 each received a flow rate of about 36 g.p.m. (about 30%); the intermediate housing 13 received a flow rate of 20 g.p.m. (about 20%). The flow distribution can be re-calibrated for a different specific engine by changing the gasket openings at entrances 17 or exits 18 which lead into or out of the specific flow circuits. This is not possible with prior art constructions.

In another important aspect, the flow circuits 16 have been redefined over the prior art to pass along only a specific section of the heat transfer wall (the latter is defined as the wall separating the cooling medium and variable volume combustion chamber). In the rotor housing, the heat transfer wall is that wall portion 29 along the extent 7 of the epitrochoid surface 20 which experiences sufficient heat in-put requiring heat extraction to maintain material stability (see FIG. 5). The flow channel 6 in the rotor housing is contoured to direct an attached streamlined flow upwardly along parts of wall portion 29 and a modified flow along the inverted sub-section **29*a***.

Experimental flow studies indicate that when a coolant is boiling at a heated surface that is inverted and the coolant is flowing parallel to the heated surface at low flow rates, a dangerous vapor binding film may develop on the surface to prevent the normal rate of heat extraction as anticipated. This film barrier to heat transfer causes the metal combustion wall temperature to increase dangerously in an attempt to reject a given amount of heat to the coolant. The turbulizer elements of this invention become of critical importance so as to scrub this inverted surface.

Figure 5:
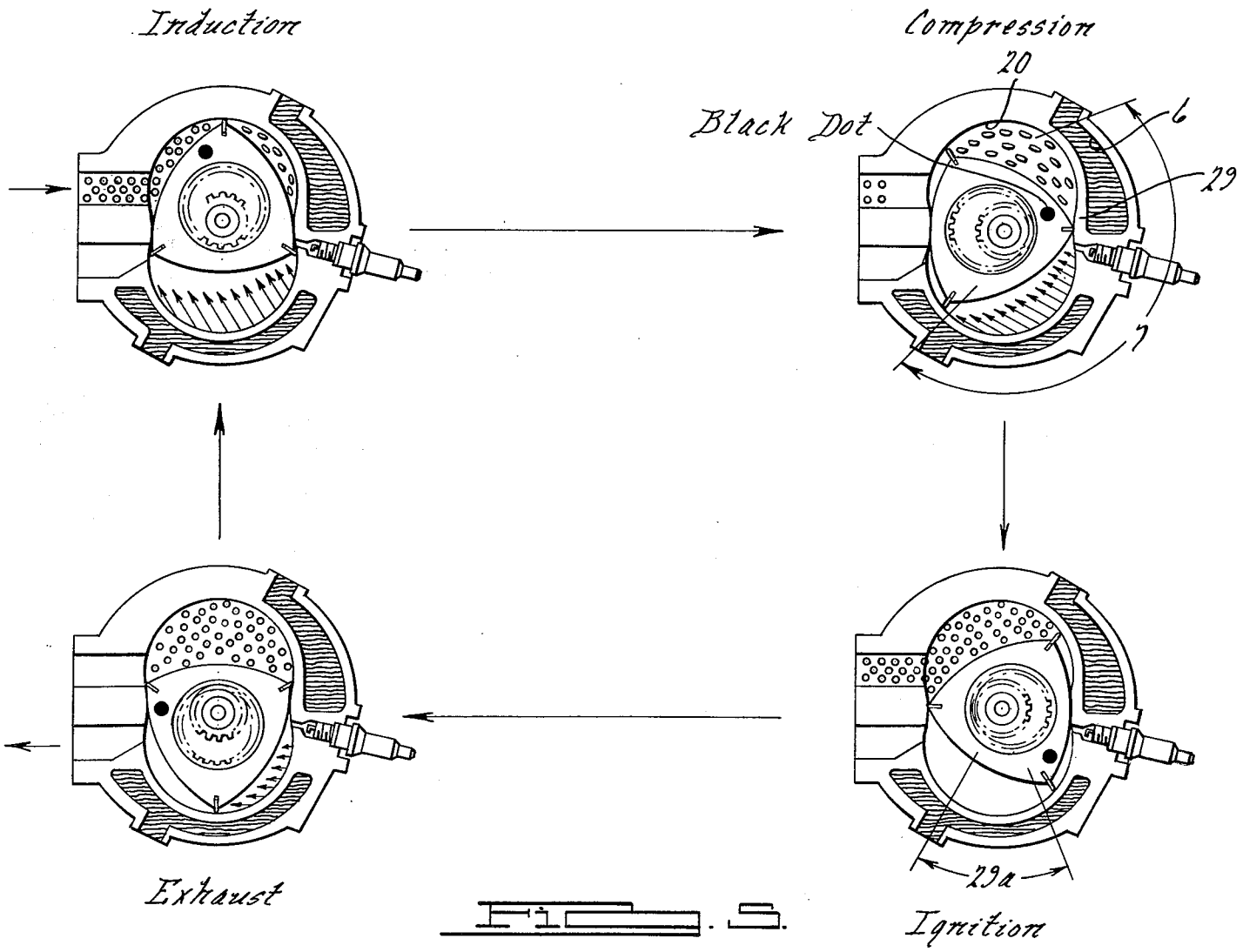
FIG. 5 is a schematic diagram illustrating the four stages of the combustion of the engine herein which can be understood by following the black dot on the rotor.

In each of the side housings 11, 13 and 15 the flow channel has been redefined to direct a flow along that portion of the vertically oriented side wall (separating the rotor and/or variable volume chamber from the cooling medium) which is a combination of the projections or silhouettes of a variable volume chamber traveling between and including the ignition and exhaust stages (see FIG. 5). If one were to incrementally turn the rotor between such stages, and note the change in silhouette of the associated chamber, and then superimpose these silhouettes one upon another, the sum or combination would produce a passage contour roughly equivalent to the redefinition of this invention. To follow the stages of FIG. 5, it is important to study the chamber adjacent the black dot.

Figure 6:
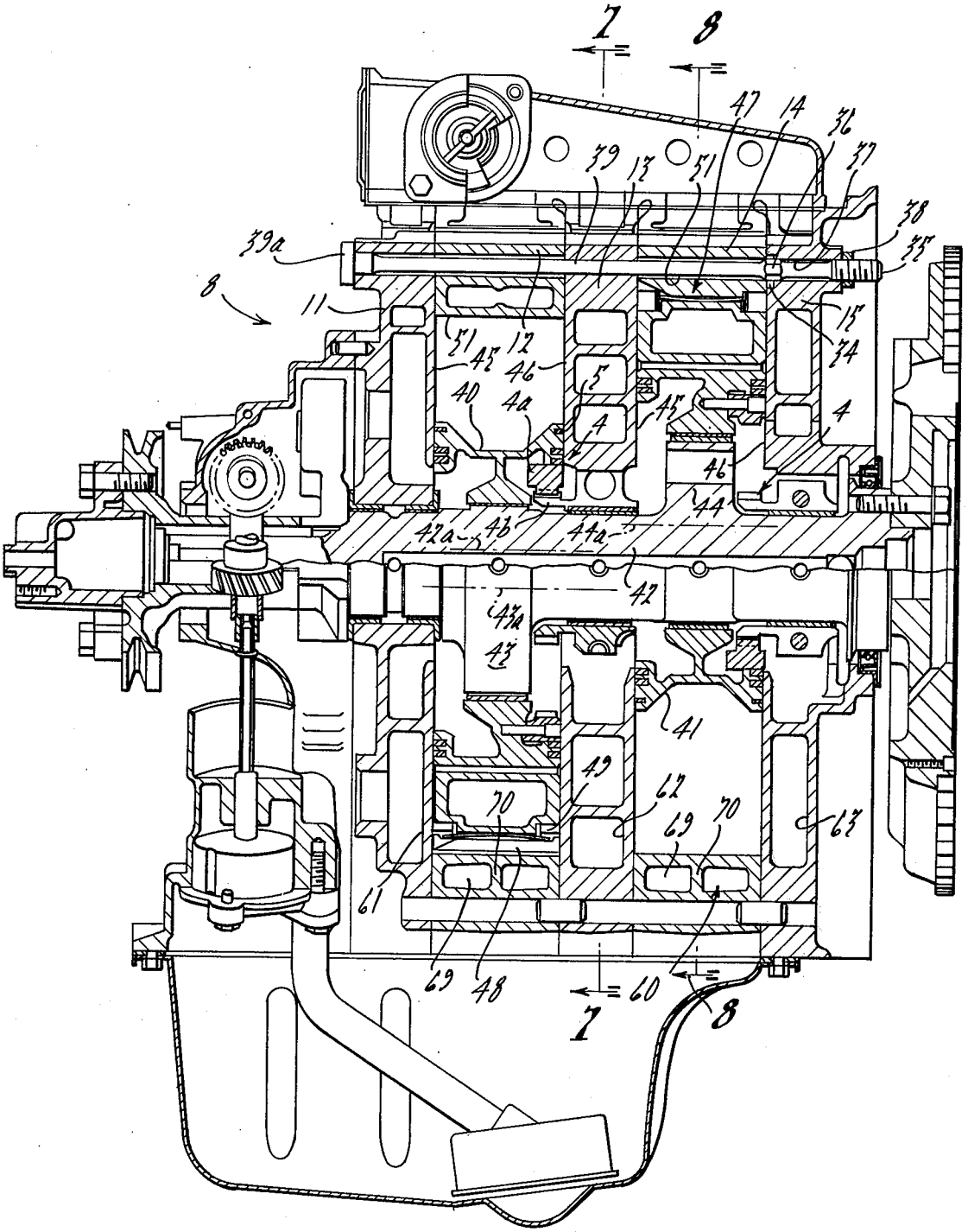
FIG. 6 is a central sectional elevational view of an engine embodying the principles of this invention.
Figure 7:
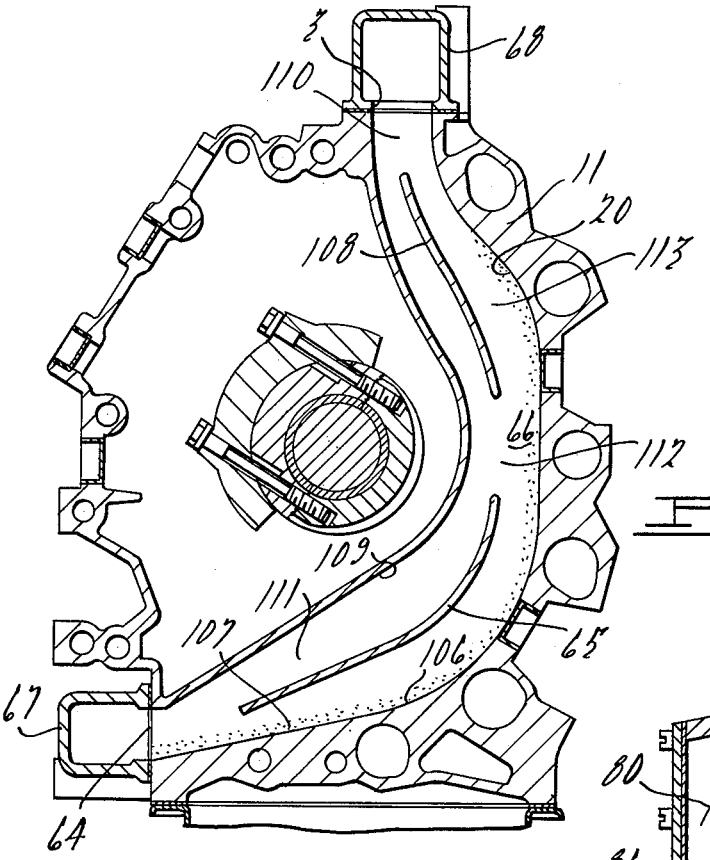
FIGS. 7 and 8 are sectional views taken respectively along lines 7—7 and 8—8 of FIG. 6.
Figure 8:
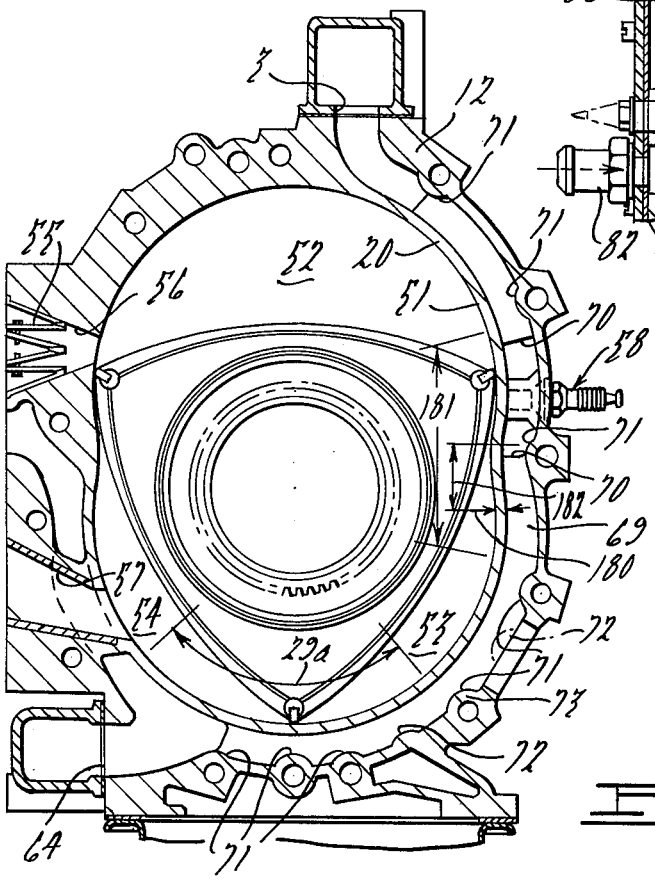

A preferred embodiment is illustrated in FIGS. 6–8. In its essentials, the engine 8 again has the stacked series of independent housing units: front side housing 11, front rotor housing 12, intermediate housing 13, rear rotor housing 14 and rear side housing 15. The housing units are held in the assembled condition, as shown, by a plurality of tie-bolts 39 (circumferentially arranged around the outer periphery of the cylinder defined by the stacked housing units). A lesser number of tie-bolts is required as compared to the prior art since a compressive force between the housing units is not as critical. Each of the tie-bolts 39 (a total of 12 in number for a 210 cu. in. engine) extent through aligned bolt openings 37 in each of the housing units and apply compressive force to the assembly between a bolt head **39*a* at one end and a threaded nut 38 received at the threaded portion 35 at the other end. Each of the tie-bolts have a polygonal-shaped surface separated from the threaded portion by the width of side housing 15. The threaded portion of the tie-bolt is snugly received in a complimentary shaped polygonal-shaped opening of an insert 34 received in an irregular opening of the rear side housing 15. The insert functions to relieve the stress or twist that may develop in the extended length of each tie-bolt by providing a locked surface adjacent the threaded portion against which torquing may be resisted. The distance between the polygonal surface 36** and threaded portion must be such that each may be forged accurately in a common piece and yet be close enough to prevent twisting in the shaft of the bolt.

Front rotor 40 and rear rotor 41 are received in the respective front and rear rotor housings; then are respectively mounted on eccentrics 43 and 44 integrally forming part of the eccentric shaft 42. The eccentrics have a center line off set from the center line of the shaft 42 as shown (center lines 44*a* and 43*a* for the eccentrics and center line 42*a* for shaft 42). The rotors together, with the epitrochoid walls 51 and side walls 45 and 46, define variable volume chambers 52, 53 and 54 (particularly shown in FIG. 8). A suitable sealing grid 47, typically comprised of an apex seal 48, corner seals 49 and side seals 5, is carried by the rotor on opposite sides to provide a dynamic sealing between the apices of the rotor and the epitrochoid surface 51 and side walls for securing the integrity of such chambers. Drive is communicated between each of the rotors and the eccentric shaft by way of split gear and bearing assembly 4, each having a one piece gear portion 4*a* secured to the rotor and a split gear and bearing portion 4*b* secured to the side housings 13 and 15. The eccentric shaft is supported for rotary movement within the intermediate and rear housing units by way of the split main gear and bearing assembly 4. The centered assembly 4, within intermediate housing 13, adds considerable support when maximum shaft deflection may occur.

A combustible mixture is introduced through an intake system which comprises an intake port 56 having a reed valve assembly 55; combusted gases are exhausted through exhaust port 57. Both ports are defined in the epitrochoid wall of the rotor housings. A spark ignition means 58 is disposed also in the trochoid wall and typically is employed at a point aligned generally with the minor axis of the epitrochoid wall. Preferably two spark plugs should be in the side housings on opposite sides thereof.

The cooling system 60 is arranged to define independent circuits 16 in each housing unit as represented in FIG. 3. To this end, the side housing units 11 and 15 and the intermediate housing 13 have enlarged predetermined variable flow passages 61, 62 and 63 respectively. Each flow passage has an entrance 64 or an exit 3 sized by way of an inserted gasket; the gasket can be replaced to redesign the opening. Thin elongated flow foils 65 are employed to regulate a controlled attached flow against the hot peripheral vertically-oriented side wall portion 66 most adjacent the combustion chamber of the rotor housings. An inlet cooling manifold or channel 67 and an outlet cooling manifold or channel 68 extend transversely between all of the housings for interconnecting the housing flow circuits into a parallel hook up. The flow circuit for the side housing and intermediate housings extend between a 7 o'clock to a 1 o'clock position when viewed in elevation as shown in FIG. 7.

The flow circuits for the rotor housings extend through a passage 69 which is subdivided through a portion thereof by web 70. Flow turbulizers 71 are contoured particularly about the bolt opening bosses 73 and turbulizers 72 are contoured as independent auxiliary surfaces. The turbulizers are arranged close to the outer wall of the housing unit to activate the flow for removing any vapors from ebullient boiling that may occur along the inverted surface section 29*a* or 182 which is adjacent the hot spot. The flow for the rotor housings is admitted at approximately the 7 o'clock position and exited at approximately the 1 o'clock position, as shown in FIG. 8.

Redefinition of Flow Rate and Character

The flow character and rate is positively graded across the flow channels of each circuit so that (a) trapped ebulliency is removed and (b) attached streamlined flow is assured at the hottest extraction zone; additionally the average flow velocity is increased over useful levels of the prior art.

With conventional cooling systems, it has been almost impossible to effectively change the temperature and flow rate of the cooling water in proportion to the heat loads at the respective stations of the heat transfer wall. Cooling water was circulated uniformly over the entire plurality of housings including relatively cold regions. In addition, all housing units, or at least the intermediate housings, were provided with only one common inlet and common outlet port. The present invention is designed to minimize the difference between the coolant temperature and the hottest metal temperature of the heat transfer walls by regulating the metal thickness between the hot working gases and the coolant, but importantly by increasing the average velocity of flow past such metal turned to the desired flow characteristic at any point along the circuit 16. The average flow rate of the cooling liquid must be predetermined by the sizing of the inlet or outlet gaskets (openings 64 and 3) and by sizing the average cross section throughout each channel to promote an average flow velocity which must be at least 10 feet per second at rated speed of engine. The cross-section at any station X along the circuit is sized according to the relationship, $Q$ (flow rate) $= V$ (speed) $\times S$ (area). For example, since the heat flux density is maximal near the spark plug location, the speed of the liquid at this region must be a maximum in order to facilitate thermal exchange and the cross-section should be minimal. Thus with the same difference between the temperature of the wall and of the liquid at the spark plug, more heat can be evacuated at the spark plug than at the other points because the liquid will circulate faster at the spark plug zone.

But if one were content with solely such an improved arrangement, one would obtain a cooling circuit which may operate under conditions of thermal exchange which may not be safe; the flow velocity must be tuned to the type of flow character desired at any one station. Thermal exchange can take place by convection or by nucleate ebullition or by transition between the two, or by film vaporization. As long as the temperature of the liquid remains below the temperature of ebullition which corresponds to normal operation of the cooling circuit, the speed and distribution of circulation of the liquid will be the primary criteria. It is preferable, therefore, according to this invention, that such thermal exchange take place at some locations by attached streamlined flow and at others by turbulated flow, depending on the existence of ebulliency and orientation of the heated surface.

Preferably, the temperature difference between the epitrochoid wall and the liquid at each station therealong should be smaller by substantially a constant value, such as between 10° and 20°C. Each station along a circuit is contoured in a free-form manner. Knowing the flow rate Q of the cooling liquid and the temperature difference between the epitrochoid wall and the liquid to be smaller by the value selected, then the cross-sections can be determined to provide a flow speed at a given station which will insure a heat exchange temperature difference by convective streamline flow or turbulant flow as selected. Determining the successive cross-sections of the active stations of a circuit in this manner will insure a velocity, particularly in certain zones, which is increased over the prior art.

The up-flow type flow of this invention per se is not by itself optimum. For example, it may appear as in FIG. 10 with smooth radially inner and outer walls 87 and 88 and a nontangential entry 89. The up-flow does run counter to the rotation of the piston 90 but flow tends to seek a streamlined effect along the outer surface 88 and becomes detached at locations along surface 87. In fact, semi-stagnant areas can be observed from water model studies. Significant flow interruption and detachment takes place at the spark plug bosses 93. Detached flow along the hottest heat transfer wall, at arc 181, is very deficient.

Figure 11:
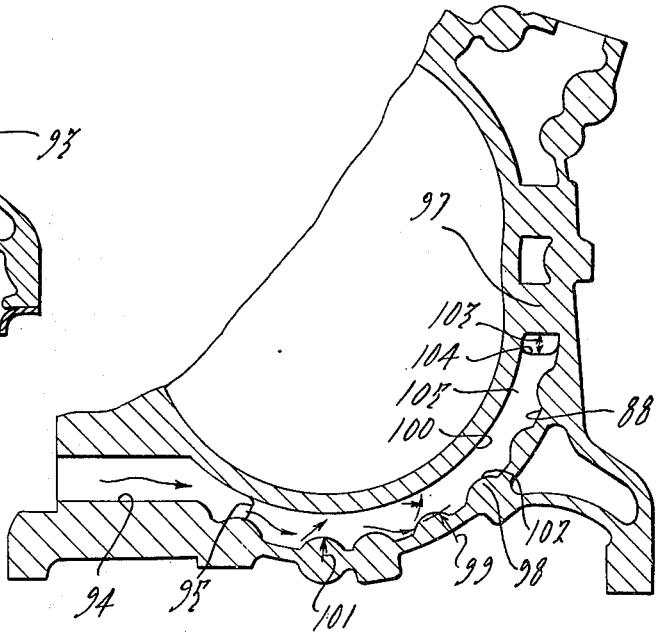
FIG. 11 is a diagramatic view similar to FIG. 10 incorporating further inventive features to optimize the cooling system.

Turning to FIG. 11, this is overcome in this invention by (a) using a tangentially directed entry 94, (b) one or more webs or supporting walls 95 are employed and are separated at 103 from the boss 97, and (c) turbulizer elements 98 are located in the flow but at the outer radial periphery to impart a vector direction to the local flow which makes at least a 20° angle (99) from the center line of flow in a radially inward direction; the flow is redirected to scrub the inverted surface along arc 182 of FIG. 8. The latter results in controlled semi-turbulent flow along smooth surface which scrubs away any boiling along the inverted portion of surface 100. The bolt openings are located in a manner to extend into the flow circuit but along the radially outer periphery. The bosses about such openings are contoured to serve as part of the turbulizers.

Figure 9:
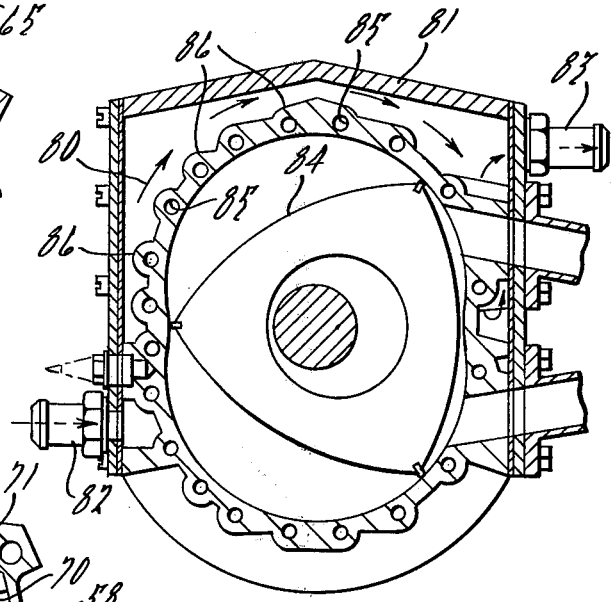
FIG. 9 is a sectional view of a typical rotor housing for a representative prior art construction.
Figure 10:
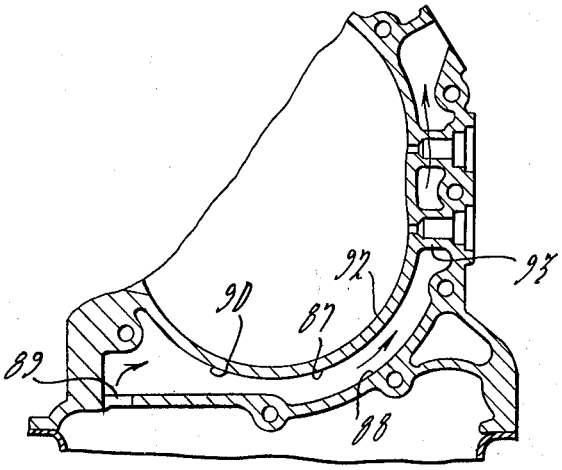
FIG. 10 is a diagramatic view of a rotor housing illustrating definition of the flow channel utilizing only part of the features of this invention.

To analyze the redefinition of flow character, we turn first to FIGS. 10 and 11 for consideration of the rotor housing flow circuit. The flow circuit is as previously indicated, of the short up-flow type on the outside with the combustion zone being of the down-flow type on the inside. The prior art has not appreciated the benefits of this flow type. One conceptualized approach by the prior art has attempted to show circumferential cooling for only one housing (see FIG. 9). However, the flow circuit 80 enters the housing 81 at 82 8 o'clock and proceeds clockwise to outlet 83 without encountering any inverted hot trochoid surface portions. The hottest zone is at the top of the engine and coolant flow is in the same direction as rotation of the piston 84. Note the placement of bolt openings 85 and their bosses 86 on the inner radial side of the flow circuit 80; this is necessitated by compressive sealing between housing primarily at the periphery of the trochoid wall. The bosses cause the flow to detach along the inner radial wall, where heat transfer is most needed. No consideration is given to flow character redefinement or grading the flow along a radius of the housing. However, more surfaces than the bolt bosses offer must be used to make a full series of useful turbulizers.

The radius of curvature 101 of each turbulizer should be selected to interrupt or penetrate the flow by between 20–60% and the turbulizer arcuate surfaces 102 should have their centers spaced apart between one and two diameters with respect to the curvature of surface 102 (see 101 for radius of surface). The separation 103 between the trailing edge 104 of web 95 and the trailing spark plug boss 97 should be about 50% of the flow channel radial width.

The front and rear side housings 15 and 11 and intermediate housing 13, must have a flow channel which redistributes the flow so that a greater amount of fluid is diverted to pass adherently to the radially outer contour of the flow channel 61 (best seen in FIG. 7). This is promoted by a tangentially directed inlet 67 which guides the flow along surface 106 and particularly in dotted zone 107 which is adjacent the hottest outer margin of the trochoid chamber; the flow channel 61 does not extend substantially radially outward beyond the trochoid chamber since this would lead to inefficient and improperly graded cooling characteristics of the prior art. The flow is promoted and maintained as streamlined substantially throughout a radius of the cross-section of the channel by separated foils 65 and 108.

There will be a predetermined gradation of flow rate from the outer surface radially inward to surface 109, surface 110 being flat and vertically oriented. The leading edges of the foils act as flow dividers or distributors. This accords with the gradation of heat extraction required. A slightly slower flow takes place in the zone 111 (to one side of the flow foil 65) due to the larger throat area and due to the shorter flow path. The total flow is rejoined and increased in velocity at 112 by a narrowing of the channel throat. Slightly greater flow is diverted to zone 113 by the leading edge of foil 108 which again grades the heat extraction rate along a radius of the channel.

Figure 12:
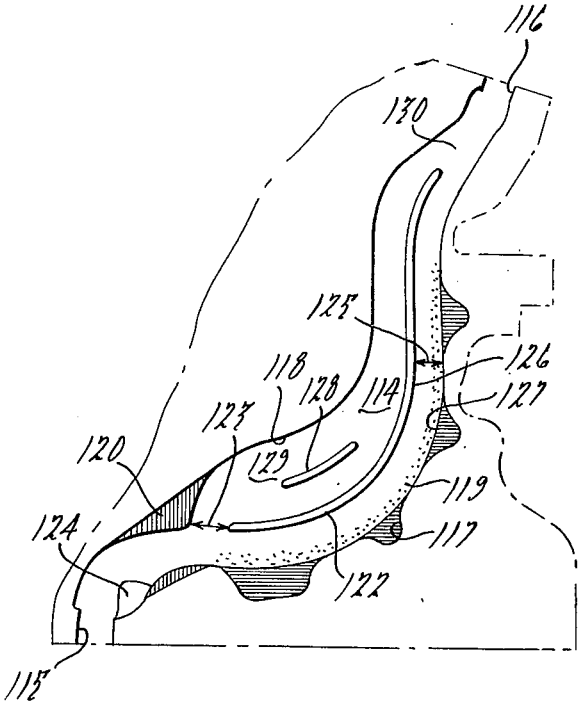

Special problems are presented when the inlet 115 and outlet 116 of the side housing flow channel 114 are not tangentially directed and when the channel is allowed to adapt to casting bosses or walls which have little or no relation to improving cooling effective. As shown in FIG. 12, for a rear or intermediate side housing, the first proposed radially outer channel wall 117 follows an irregular contour conforming to available interior cast space. This was initially thought not to be a problem since the flow would be introduced through an inlet 115 for guiding the flow smoothly along the radially inner wall 118. Flow studies indicated considerable flow stagnation and a highly undesirable flow gradation such that inadequate heat transfer to the cooling medium took place along dotted zone 119.

In accordance with this invention the flow channel for the rear side housing of FIG. 12 was redefined to have a smoothly contoured flow diverter 120 which was dimensioned to cooperate with the leading edge 121 of foil 122 to throttle flow through throat area 123; the protuberance 124 was removed to allow better fluid turning and access to throat 123. Foil 122 was arranged to extend from a 6 o'clock position to 1 o'clock position, maintaining a slightly narrowing spacing 125 between foil surface 126 and new smooth wall surface 127, having irregularities filled in. The narrow of the spacing 125 gradually increases flow velocity. A second foil 128 is employed to distribute the flow in the desired slow moving region 129. The divided portions of the flow are merged at 130 and increased in velocity by a throttling of the flow passage just prior to outlet 116 which is tangential to the radially outer surface 127.

Figure 13:
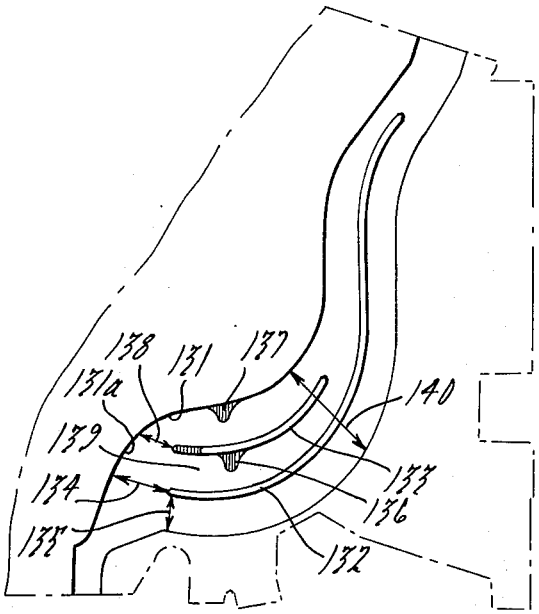
FIGS. 12 and 13 are diagramatic views of a rear side housing and a front side housing incorporating optimized flow character and rate redefinition.

Alternatively, the flow can be redefined as for the front housing shown in FIG. 13. Here radially inner surface 131 has an entrance section **131*a* contoured to provide a smooth throttling transition with surface 131 and with each of foils 132 and 133. The leading edge of foil 132 is arranged to be spaced from section 131*a* to promote an equal division of the flow at 134 and 135 respectively. The flow passing 134 is restricted by flow throttle protuberances 136 and 137 integrally formed on the radially outer side 133*a* of foil 133 and on surface 131 respectively. In addition the leading edge of foil 133 is extended to provide a throttling of flow at 138 to insure slightly greater flow through zone 139. Radial gradation of the flow across the total channel 140** is properly assured.

Figure 14:
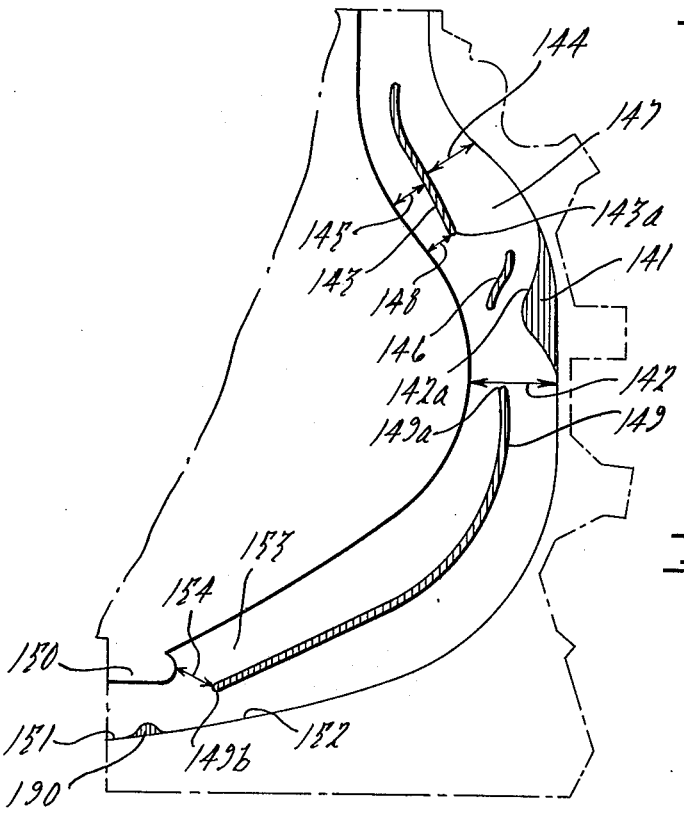
FIG. 14 is a diagramatic view of an intermediate housing having side spark plug bosses and other bosses interrupting the normal flow, the channel being redefined to optimize cooling.

In more advanced rotary engine designs, the spark plugs are located in the side housings and because such plugs need access to the variable volume chamber, their structural boss 141 will interrupt the flow channel 142 (see FIG. 14). As a result, stagnant flow will occur at the downstream side 142*a* of the boss; this condition is most serious since the need for high heat transfer is greatest at this location. Redefinition and graded flow in accordance with this invention requires that foil 143 be located radially inward leaving spacing 144 much greater than spacing 145. A contoured supplementary foil 146 is employed to insure adequate flow along surface 142*a;* leading edge 143*a* is spaced from auxiliary foil 146 so as to allow considerable flow up into zone 147. The leading edge provides a throttle for the flow across 148. Foil 149 has a trailing edge 149*a* considerably separated from boss 141.

Some intermediate housings have a need for a boss 150 adjacent the inlet 151 to accommodate mechanical strength features. Unfortunately, this may divert too much fluid flow to the outer radial region, since a tangential inlet 152 is employed. The leading edge 149*b* of foil 149 must be located as is to promote streamlined flow along surface 152 but proper control of fluid must be introduced to zone 153. This is accomplished by use of diverter 190 effective to provide a fluid vector which can enter throttle area 154 and insure a lower but adequate flow in zone 153.

Figure 15:
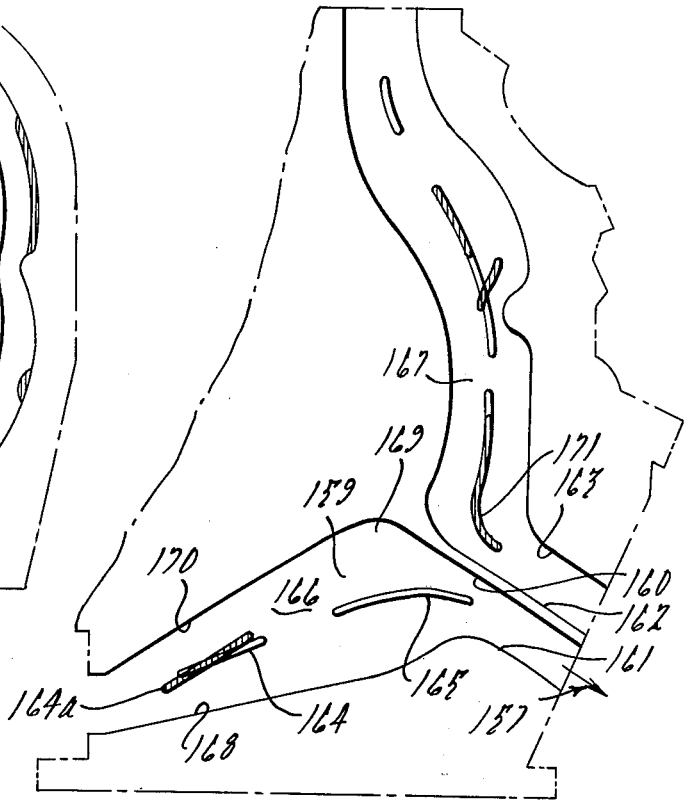

Another unusual problem may be presented with respect to achieving a radially gradated flow when the flow circuit must leave the housing before it has completed its full circuit. This may occur in a front, rear, or intermediate housing design when an oil cooler is attached at 157 (see FIG. 15). Accordingly, the passage 168 is arranged not only to traverse the first zone 166 kidney-shaped area along vertically oriented wall 159, but must abruptly exit radially outwardly along surface 160 and 161; after passing through the oil cooler, the flow returns along radially directed surfaces 162 and 163 and turns to traverse zone 167 for completing said kidney-shaped heat extraction zone. Separated foils 164 and 165 are critically useful in controlling the flow in the first zone 166 to remain attached and streamlined along surface 168 while making the abrupt turn. To prevent vapor entrapment at point 169, foil 164 must be relocated as shown to throttle a greater flow along surface 170 by locating leading edge 164*a* closer to surface 168. Foils 165 and 171 must be shaped to guide the flow during exiting and re-entrance to reduce flow resistance and velocity distribution so that the high rate flow is along the hottest zone.

Figure 16:
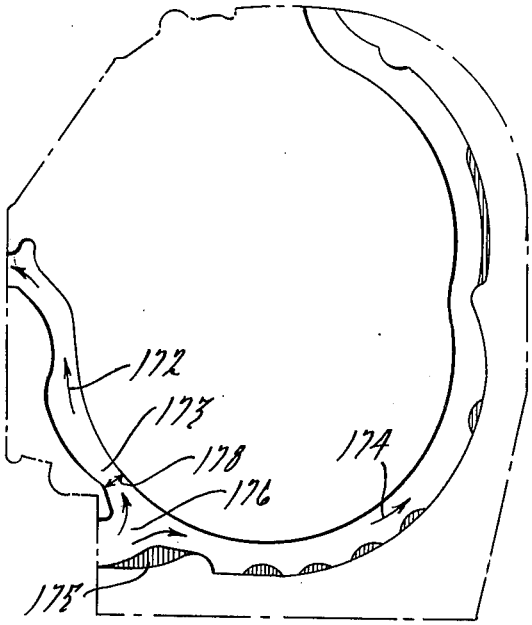
FIGS. 15 and 16 are diagramatic views of side housing and rotor housing respectively where the flow is split or withdrawn for purposes other than combustion chamber cooling.

In FIG. 16, the flow circuit for a rotor housing is shown as split so that one portion 172 is directed clockwise to extend upwardly to a 5 o'clock position for exiting into a heat-exchanger unit for assisting in the preheating of an air-fuel mixture for the rotary engine and to cool surface around exhaust port. The flow portion 172 must be guided about an exhaust port boss 173 and this is facilitated by contouring the outer surface of boss 173 and channel throat to have a slower flow thereabout. The other flow portion 174 is directed counterclockwise as in FIG. 8. A flower diverter 175 is employed to improve flow division at 176 to be about 75–25%. The flow portion 173 is throttled across throat 178 to insure a lesser and proper flow in this portion.

Wall Variation

A unique epitrochoid combustion chamber wall 20 (FIG. 8) for the rotor housing has been designed for the rotor housing. Specialized features in the cooled sector 7 include novel circumferential variation of the wall thickness 180 to reduce metal distortion. In sector 181 of FIG. 8, the cast wall thickness is made uniquely thin (about 0.22–0.26 inches) and is structurally reinforced in a novel manner. The increased heat transfer to the coolant along sector 181 permits the hot spot temperature to be lowered. Preferably, the spark plugs should be removed from the trochoid wall and placed in the side housing wall as in FIG. 14. However, if they are to be retained in the trochoid wall, as shown in FIG. 8 for one spark plug, and in FIG. 11 for leading and trailing plugs, then the leading spark plug should be relocated upstream an equal distance from the trochoid minor axis as is the trailing plug for eliminating the hot spot caused by the spark plug "bosses".

Because of the proposed wall variation, the ultra thin sector 181 in the hot spot area (adjacent the spark plugs) is backed up by one longitudinal strengthening web 70 which prevents excessive deflection or overstressing of the trochoid surface. The cooler area, such as along section 182, has a thicker wall section and may also have little or no coolant flowing in certain zones to eliminate overcooling these surfaces. The thickness of the trochoid wall is varied according to a computer analysis of the various conductive needs at locations along the wall 61. At certain portions, where maximum cooling is desired, the ultra thin wall section is no more than 0.22 inches; in those areas where reduced cooling is required, such as along sector 182, the appropriate thickness can be substantially greater and preferably about eight times thicker. The thinnest section utilized by the prior art to date has been known to be 0.33 inches and has not been varied as depicted herein.

Redefinition of Coolant and Tolerable Coolant Temperature

A higher temperature level at the surface around the entire epitrochoid wall 61 at all road load conditions is desirable. Because of the general geometry of the rotary internal combustion engine which has a large surface-to-volume ratio compared to the combustion chamber of an average reciprocating engine, a greater amount of the heat is transferred to the coolant. Accordingly, if the coolant is run at slightly higher temperatures, an increase in fuel economy will be obtained. In conformity with this invention, the coolant is controlled to a higher exit temperature particularly in the range of 230°–235°F at 8 inches of manifold vacuum and above. To do this, a super bypass system is utilized where the water outlet manifold allows water circulation through the engine without flowing through the radiator. The resulting higher average temperature of the trochoid surface is possible because of the low temperature differential around the housing and the higher coolant temperature maintained at road load. Such temperature increase does not have a great effect on fuel economy but it does have a large effect on trochoid surface wear and the co-efficient friction between the apex seal and the trochoid housing. It is speculated that the lower friction along the hotter surface gives a slight increase in fuel economy, such as in the range of 1%.

Additionally, water or other coolant mediums such as methoxy propanol may be utilized to facilitate the higher operating temperatures for the cooling system. Methoxy propanol forms azeotropes with water and therefore is insensitive to variable concentrations between water and itself; the propanol tends to nucleate boiling at lower metal temperatures which would be important if an condensor were cmployed in this system as a substitute for the radiator. The heat exchange efficiency is highly increased with such a system.

We claim as our invention:

1. In a rotary internal combustion engine having variable volume combustion chambers defined by a rotary piston and a surrounding housing, said engine having means for igniting a combustible mixture introduced to said chambers at a combustion zone thereof, said engine further having means for defining an exhaust zone for withdrawing combusted gases, a cooling system for said engine, comprising:

a. at least one flow channel for carrying a cooling medium and extending along an arcuate portion of said combustion chamber, b. a heat transfer wall separating said flow channel from said combustion chamber and having a smooth surface forming part of said channel, said heat transfer wall extending at least between said combustion zone and said exhaust zone and having a variable thickness therealong which is comprised of a taper at the leading and trailing portions of said wall separated by a uniformly thin section, said wall being so tapered in thickness from a minimum of 0.22 inches at said thin section adjacent said combustion zone to a maximum of at least six times the thin section thickness at said exhaust zone, c. means in said channel to control said flow therethrough and said passage to insure a controlled flow against said smooth surface of said wall without detachment, and d. means in said channel to disrupt ebullience that may develop along any portion of said wall surface, said system insuring that the operating temperature of said heat transfer wall does not vary greater than 60°F.

2. The cooling system as in claim 1, in which said transfer wall has webbing extending normal to said surface of said heat transfer wall providing structural support for that portion of the wall which has a uniform taper.

3. The system as in claim 1, in which said means (c) has diverters controlling said flow as part of the flow channel outer wall and insuring said controlled characteristic.

4. The system as in claim 1, in which said means (d) has contoured surfaces stationed along the outer periphery of said flow diverting local flow to interrupt the ebullience by controlled turbulence.

5. In a rotary internal combustion engine having variable volume combustion chambers, means for igniting a combustible mixture in said chamber, an improved cooling system, comprising:

a. a plurality of independent housing units cooperating to define said variable volume combustion chambers, each housing unit having walls defining at least one continuous passage extending long between 170°–200° of the annular periphery of said engine for defining a circuit therein, said circuits being commonly supplied with pressurized fluid and commonly reconnected to a return sump in a manner so that each circuit receives supply fluid independently of the others, each housing unit having at least one heat transfer wall interposed between said variable volume chambers and said passage in each of said respective housing units, at least one portion of the heat transfer wall is inverted so as to face oppositely with respect to the top of the engine, said heat transfer wall being subject to a variable temperature heat input, said passage having auxiliary turbulizer means effective to divert controlled turbulent flow along a radially inwardly biased vector to disrupt ebullience along said inverted surface, each cross-sectional station of said passage being sized to control the flow velocity and character through each housing unit independent of others so that heat transfer is controlled to maintain the temperature of the transfer wall in each housing unit at a predetermined target temperature below ebullience, and b. aperture means at the entrance and exit of each of said passages regulating the fluid flow distributed to each housing circuit.

6. The system as in claim 5, in which said target temperature at each station therealong does not vary greater than 100°F and said system has turbulizer means adjacent that portion of said heat transfer wall which experiences the hottest temperatures whereby circumferential flow therethrough is forced to provide controlled turbulence and scavenge closely the smooth surface of said heat transfer wall.

7. The system as in claim 5, in which one or more of said continuous passages have a tangentially directed entry effective to reduce flow resistance while promoting controlled attached flow along at least one wall of said passage, the net pressure drop across all said commonly supplied circuits being reduced.

8. A water cooling system for a rotary internal combustion engine, said engine having at least one combustion chamber confined at its outermost periphery by a trochoid wall, gases flowing in said chamber in a predetermined direction as induced by a rotor, the system comprising:

a. walls defining at least three flow channels, two of said flow channels being side channels with one extending along each side of said chamber, each side channel being disposed substantially radially inwardly of said trochoid wall, said side channels being generally crescent shaped with a variation in the cross sectional area of at least 400% between the smallest and largest cross sectional areas, the third flow channel being an outermost channel extending about and radially outwardly of said trochoid wall, said outer channel being arcuately shaped with a variation in cross sectional area less than 200% between the largest and smallest cross sectional areas thereof, and means other than smooth portions of said channel walls providing a positively graded flow rate and/or distribution across the radial extent of each of said flow channels so that said channel variation and means cooperating to provide a predetermined variable heat extraction are balanced to maintain a temperature of said walls within temperature limits of 100°F.

9. The system as in claim 8, in which said grading means comprises flow foils arranged to extend transverse to the flow in said channels and having leading edges distributing the volume of fluid admitted to said flow channel to effect a greater velocity and flow volume along the radially outermost zone of said side channels than along the radially innermost zone of said outer channel.

10. The system as in claim 8, in which said grading means comprises flow foils effective to promote and insure an attached streamlined flow along the outermost wall of said side channels.

11. The system as in claim 8, in which said grading means has flow turbulizer surfaces adjacent any inverted surfaces of said channel with respect to the top of the engine, said turbulizer surfaces being in the outer wall of said outer channel, said grading means imparting a vector direction to the flow which makes an angle of at least 30° with the center line of flow therethrough whereby flow is directed radially inwardly to scrub the inner surface of said outer channel.

12. The system as in claim 8, in which a spark plug boss interrupts a portion of the outer flow channel and in which said grading means for the outer channel comprises at least one flow foil bisecting the outer channel along a plane perpendicular to the axis of the engine, said foil having a trailing edge which is spaced from said spark plug boss by a distance of at least 50% of the width of the channel at the trailing edge of the foil.

13. The system as in claim 8, in which said grading means comprises flow diverters which are an integral part of said channel walls but contoured to change momentum of fluid flow therethrough to insure controlled streamlined flow along a predetermined wall section of a channel.

14. The system as in claim 8, in which said outer channel has one section thereof which has an inverted surface with respect to the top of the engine, the fluid flow in said channel being counter to the direction of flow of gases in said chamber, and said grading means directs portions of flow through said outer channel to scrub the inverted surface and eliminate flow stagnation or attachment of ebulliency which may occur at said inverted surface.

15. The system as in claim 14, in which said grading means comprises flow turbulizers which have uniformly arcuately contoured flow surfaces disposed along the outer wall of said outer channel and being spaced along the extent of said inverted surface, the centers of curvature of said turbulizers being spaced apart within the range of 1–2 diameters of the flow surfaces, the curvature of said turbulizers penetrating from the outer surface of said outer channel radially inwardly to between 20 and 60% of the transverse extent of the outer channel.

16. The water cooling system as in claim 8, in which said side channels each contain a spark plug boss interrupting a portion of flow along the radially outer zone thereof, said grading means having a supplementary flow foil and conforms the flow along the outer zone to be streamlined and attached even to the reverse contour of the spark plug boss, whereby fluid flow throughout said side channel has an attached streamline flow along the entire outer peripheral zone thereof.

17. The water cooling system as in claim 16, in which said supplementary flow foil is disposed at least partially downstream of the spark plug boss.

18. The cooling system as in claim 8, in which said flow channels extend from a 7 o'clock position to a 1 o'clock position, when the channels are viewed in elevation, with fluid entering said channels at the bottom of the engine and exiting from the top thereof, said fluid flow being continuous therethrough counter to the flow of gases in said chamber, and said fluid flow having a volume flow rate at least 10 gpm at rated engine speed.

19. The cooling system as in claim 18, in which at least one of said flow channels is diverted to the exterior of the engine and returns during flow from the entrance to the exit of said channel, said grading means directing said flow along both divided portions of said flow so that the flow remains at said rate and remains as an attached streamline flow continuously along the outer zone of said flow channel.

* * * * *